US010286529B2

(12) United States Patent
Kiyohara et al.

(10) Patent No.: US 10,286,529 B2
(45) Date of Patent: May 14, 2019

(54) SCREW-TIGHTENING POWER TOOL

(71) Applicant: MAKITA CORPORATION, Anjo-shi (JP)

(72) Inventors: Takashi Kiyohara, Anjo (JP); Takashi Sakamoto, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 323 days.

(21) Appl. No.: 14/896,784

(22) PCT Filed: Feb. 26, 2014

(86) PCT No.: PCT/JP2014/054682

§ 371 (c)(1),
(2) Date: Dec. 8, 2015

(87) PCT Pub. No.: WO2014/208125

PCT Pub. Date: Dec. 31, 2014

(65) Prior Publication Data

US 2016/0121466 A1 May 5, 2016

(30) Foreign Application Priority Data

Jun. 27, 2013 (JP) ..... 2013-135298

(51) Int. Cl.
*B25F 5/00* (2006.01)
*B25F 5/02* (2006.01)
(Continued)

(52) U.S. Cl.
CPC ..... *B25B 21/00* (2013.01); *B25B 23/141* (2013.01); *B25B 23/18* (2013.01); *B25F 5/001* (2013.01);
(Continued)

(58) Field of Classification Search
CPC .. F21V 33/0084; F21Y 2115/10; B25B 21/00; B25B 23/141; B25B 23/18; B25F 5/001; B25F 5/008; B25F 5/02
(Continued)

(56) References Cited

U.S. PATENT DOCUMENTS 2,456,571 A 12/1948 Turner et al.
3,019,673 A 2/1962 Stig et al.
(Continued)

FOREIGN PATENT DOCUMENTS

CN 102825584 A 12/2012
CN 202862165 U 4/2013
(Continued)

OTHER PUBLICATIONS

Partial European Search Report from the European Patent Office dated Feb. 3, 2017 in related EP application No. 14 818 338.7, including Supplemental Partial European Search Report and examined claims 1-14.
(Continued)

*Primary Examiner* — Tsion Tumebo
(74) *Attorney, Agent, or Firm* — J-Tek Law PLLC; Jeffrey D. Tekanic; Scott T. Wakeman

(57) ABSTRACT

A screw-tightening power tool includes a motor housing. A brushless motor has a stator that is fixed to the motor housing and a rotor that is rotatable relative to the stator. A tip-tool retaining part is configured to hold a bit and a clutch is disposed between the rotor and the tip-tool retaining part. A grip housing extends from the motor housing. A switch assembly is provided in the grip housing and a trigger is held by the switch assembly. A sensor-circuit board is fixed to the stator. The sensor-circuit board and the switch assembly are connected by a first cord, and the stator and the switch assembly are connected by a second cord.

22 Claims, 9 Drawing Sheets

(51) Int. Cl.

| | |
|---|---|
| ***B25B 21/00*** | (2006.01) |
| ***B25B 23/18*** | (2006.01) |
| ***F21V 33/00*** | (2006.01) |
| ***F21Y 115/10*** | (2016.01) |
| ***B25B 23/14*** | (2006.01) |

(52) U.S. Cl.
CPC ..... *B25F 5/008* (2013.01); *B25F 5/02* (2013.01); *F21V 33/0084* (2013.01); *F21Y 2115/10* (2016.08)

(58) Field of Classification Search
USPC ..... 362/120, 119
See application file for complete search history.

(56) References Cited

U.S. PATENT DOCUMENTS 3,114,423 A 12/1963 Naslund
3,203,490 A 8/1965 Mccarty et al.
3,456,740 A 7/1969 Paule et al.
3,517,755 A 6/1970 Badcock
4,962,681 A 10/1990 Yang
5,052,497 A 10/1991 Houben et al.
5,113,951 A 5/1992 Houben et al.
5,134,909 A 8/1992 Sasaki
D337,038 S 7/1993 Sakamoto et al.
D345,090 S 3/1994 Okumura
5,343,961 A * 9/1994 Ichikawa ..... B25B 21/00 173/178
5,372,206 A 12/1994 Sasaki et al.
5,482,413 A 1/1996 Argaud
5,639,194 A 6/1997 Harroun
D399,055 S 10/1998 Coady
5,868,208 A * 2/1999 Peisert ..... B23D 29/005 173/110
D406,740 S 3/1999 Zurwelle
6,102,134 A 8/2000 Alsruhe
6,127,751 A 10/2000 Kristen et al.
6,199,383 B1 3/2001 Pusateri
6,321,622 B1 11/2001 Tsuge et al.
6,325,157 B1 12/2001 Arakawa et al.
D457,046 S 5/2002 Boyle et al.
D457,797 S 5/2002 Huang
6,455,186 B1 9/2002 Moores et al.
D467,481 S 12/2002 Watson
D470,028 S 2/2003 Cooper
6,536,537 B1 3/2003 Sasaki et al.
6,543,549 B1 4/2003 Riedl et al.
6,688,407 B2 2/2004 Etter et al.
6,776,245 B2 8/2004 Kristen et al.
D498,400 S 11/2004 Wu
6,866,105 B2 3/2005 Pfisterer et al.
D507,952 S 8/2005 Wu
6,949,309 B2 9/2005 Moores et al.
D517,323 S 3/2006 Raimondo et al.
D519,808 S 5/2006 Otsuka et al.
D531,874 S 11/2006 Wu
7,140,451 B2 11/2006 Yoshimizu et al.
D534,405 S 1/2007 Concari
D550,052 S 9/2007 Lee
7,308,950 B2 12/2007 Faatz et al.
7,331,408 B2 2/2008 Arich et al.
7,498,526 B2 3/2009 Lohr et al.
D605,488 S 12/2009 Aglassinger
D605,489 S 12/2009 Aglassinger
7,677,752 B2 3/2010 Tadokoro et al.
7,705,497 B2 4/2010 Arich et al.
D617,168 S 6/2010 Yamamoto et al.
7,786,627 B2 8/2010 Riedl
7,793,572 B2 9/2010 Hirt et al.
7,810,414 B2 10/2010 Hsu
7,823,483 B2 11/2010 Yamada
7,988,538 B2 8/2011 Trautner et al.
D647,774 S 11/2011 Okuda et al.
D647,775 S 11/2011 Tószegi
8,067,860 B2 11/2011 Hoffmann et al.
8,113,297 B2 2/2012 Sakakibara et al.
8,261,853 B2 9/2012 Hachisuka
8,267,192 B2 9/2012 Lopano et al.
D670,989 S 11/2012 Kawase et al.
D672,627 S 12/2012 Kawase et al.
8,333,252 B2 12/2012 Britz et al.
8,348,727 B2 1/2013 Trautner et al.
8,354,183 B2 1/2013 Konuma et al.
D675,500 S 2/2013 Taniguchi et al.
D677,137 S 3/2013 Kawase et al.
D678,744 S 3/2013 Aoki et al.
D679,160 S 4/2013 Okuda et al.
D679,161 S 4/2013 Kawase et al.
8,418,778 B2 4/2013 Eshleman et al.
8,430,182 B2 4/2013 Soika et al.
8,499,850 B2 8/2013 Hofbrucker et al.
8,657,029 B2 2/2014 Miyazawa et al.
8,714,282 B2 5/2014 Chen et al.
D725,981 S 4/2015 Elder et al.
D737,647 S 9/2015 Elder et al.
D739,200 S 9/2015 Elder et al.
D753,976 S 4/2016 Kalinowski
9,550,290 B2 1/2017 Miyazawa et al.
9,559,628 B2 1/2017 Sergyeyenko et al.
9,808,925 B2 * 11/2017 Yamada ..... B25D 17/20
2003/0146008 A1 8/2003 Andriolo
2004/0011544 A1 1/2004 Cooper et al.
2004/0112616 A1 6/2004 Broghammer et al.
2004/0188119 A1 9/2004 Chen
2005/0230134 A1 10/2005 Wu
2005/0236168 A1 10/2005 Lennartz
2005/0247466 A1 11/2005 Andriolo et al.
2005/0279517 A1 12/2005 Hoffman et al.
2006/0011367 A1 1/2006 Teng et al.
2006/0088393 A1 4/2006 Cooper
2006/0137144 A1 6/2006 Tillim et al.
2006/0225540 A1 10/2006 Tsai et al.
2007/0131439 A1 * 6/2007 Hashimoto ..... B23B 31/005 173/48
2007/0201748 A1 * 8/2007 Bixler ..... B25F 5/001 382/225
2007/0237591 A1 10/2007 Ohlendorf
2008/0025017 A1 1/2008 Tadokoro et al.
2008/0187822 A1 8/2008 Breitenbach
2008/0230245 A1 9/2008 Matsunaga
2009/0065228 A1 * 3/2009 Hashimoto ..... B23B 31/005 173/48
2009/0241744 A1 10/2009 Matsunaga
2010/0096156 A1 4/2010 Miyazawa et al.
2010/0236889 A1 9/2010 Sato
2010/0253162 A1 10/2010 Sakamaki et al.
2011/0017483 A1 * 1/2011 Baumann ..... B25D 11/062 173/162.2
2011/0079409 A1 4/2011 Sakakibara et al.
2011/0094764 A1 4/2011 Wei
2011/0127059 A1 * 6/2011 Limberg ..... F16D 7/044 173/216
2011/0139479 A1 6/2011 Nagasaka et al.
2011/0180286 A1 7/2011 Oomori et al.
2011/0209888 A1 9/2011 Elsworthy
2011/0214547 A1 9/2011 Inayoshi
2011/0297409 A1 12/2011 Chen et al.
2011/0303718 A1 12/2011 Spasov et al.
2012/0043102 A1 2/2012 Okuda
2012/0061117 A1 3/2012 Nagasaka et al.
2012/0073847 A1 3/2012 Nagasaka et al.
2012/0080963 A1 4/2012 Yoshikawa
2012/0085560 A1 4/2012 Kuroyanagi et al.
2012/0090863 A1 4/2012 Puzio et al.
2012/0160530 A1 6/2012 Ikuta et al.
2012/0169256 A1 7/2012 Suda et al.
2012/0175139 A1 * 7/2012 Ukai ..... B25B 21/008 173/11
2012/0199372 A1 * 8/2012 Nishikawa ..... B25B 21/02 173/132
2012/0279736 A1 * 11/2012 Tanimoto ..... B25B 21/02 173/2

(56) References Cited

U.S. PATENT DOCUMENTS

| | | | | |
|---|---|---|---|---|
| 2012/0292865 | A1 | 11/2012 | Sugimoto et al. | |
| 2012/0318549 | A1 | 12/2012 | Nagasaka et al. | |
| 2012/0319508 | A1 | 12/2012 | Oomori | |
| 2013/0000934 | A1 | 1/2013 | Tadokoro et al. | |
| 2013/0048325 | A1* | 2/2013 | Kuehne | B25F 5/001 173/47 |
| 2013/0062088 | A1* | 3/2013 | Mashiko | B25B 21/02 173/2 |
| 2013/0075121 | A1* | 3/2013 | Nakamura | B25B 21/02 173/94 |
| 2013/0105187 | A1 | 5/2013 | Agehara et al. | |
| 2013/0105188 | A1 | 5/2013 | Sakamaki et al. | |
| 2013/0149581 | A1 | 6/2013 | Yoshikawa | |
| 2013/0186661 | A1* | 7/2013 | Okubo | B25D 11/005 173/2 |
| 2013/0189041 | A1* | 7/2013 | Abe | B23B 49/006 408/5 |
| 2013/0333910 | A1* | 12/2013 | Tanimoto | B25B 21/02 173/176 |
| 2014/0159919 | A1 | 6/2014 | Furui et al. | |
| 2014/0174778 | A1 | 6/2014 | Aoki et al. | |
| 2014/0318821 | A1 | 10/2014 | Wyler et al. | |
| 2015/0014007 | A1 | 1/2015 | Ukai et al. | |

FOREIGN PATENT DOCUMENTS

| | | | |
|---|---|---|---|
| CN | 103085018 | A | 5/2013 |
| CN | 103158118 | A | 6/2013 |
| DE | 10212721 | A1 | 9/2002 |
| DE | 10109956 | | 4/2009 |
| DE | 202013105823 | U1 | 4/2014 |
| EP | 1690649 | A1 | 8/2006 |
| EP | 2186609 | A2 | 5/2010 |
| EP | 2221150 | A1 | 8/2010 |
| EP | 2258518 | A2 | 12/2010 |
| EP | 2363246 | A2 | 9/2011 |
| EP | 2444202 | A2 | 4/2012 |
| EP | 2489473 | A2 | 8/2012 |
| EP | 2402123 | B1 | 5/2013 |
| JP | S593822 | Y2 | 2/1984 |
| JP | H0911158 | A | 1/1997 |
| JP | 2004255503 | A | 9/2004 |
| JP | 2005254400 | A | 9/2005 |
| JP | 2006159307 | A | 6/2006 |
| JP | 2006255837 | A | 9/2006 |
| JP | 2007276108 | A | 10/2007 |
| JP | 2008030126 | A | 2/2008 |
| JP | 2008044024 | A | 2/2008 |
| JP | 2008062337 | A | 3/2008 |
| JP | 2008173716 | A | 7/2008 |
| JP | 2008183691 | A | 8/2008 |
| JP | 2009078322 | A | 4/2009 |
| JP | 2009083058 | A | 4/2009 |
| JP | 2009101499 | A | 5/2009 |
| JP | 2010036260 | A | 2/2010 |
| JP | 2010046739 | A | 3/2010 |
| JP | 2010069598 | A | 4/2010 |
| JP | 2010201512 | A | 9/2010 |
| JP | 2010214518 | A | 9/2010 |
| JP | 2010228039 | A | 10/2010 |
| JP | 2011005574 | A | 1/2011 |
| JP | 2011230229 | A | 11/2011 |
| JP | 2011235372 | A | 11/2011 |
| JP | 2012040659 | A | 3/2012 |
| JP | 2012196737 | A | 10/2012 |
| JP | 2013006253 | A | 1/2013 |
| JP | 2013094063 | A | 5/2013 |
| JP | 2013094912 | A | 5/2013 |
| WO | 2011052260 | A1 | 5/2011 |
| WO | 2013014914 | A2 | 1/2013 |
| WO | 2013108556 | A1 | 7/2013 |

OTHER PUBLICATIONS

Extended European Search Report from the European Patent Office dated Jun. 27, 2017 in related EP application No. 14818338.7, including European Search Opinion, Supplementary European Search Report, and examined claims 1-14.

Office Action from the Japanese Patent Office dated Dec. 21, 2017 in counterpart Japanese application No. 2017-011467, and machine translation thereof.

Office Action from the Japanese Patent Office dated Sep. 26, 2017 in counterpart Japanese application No. 2017-011467, and machine translation thereof.

Office Action from the Chinese Patent Office dated Apr. 1, 2017 in related Chinese application No. 201480036244.3, machine translation thereof, and supplemental search report.

English translation of the International Search Report from parent application No. PCT/JP2014/054682.

English translation of the Written Opinion of the International Searching Authority from parent application No. PCT/JP2014/054682.

Office Action from the Japanese Patent Office dated Sep. 27, 2016 in related Japanese application No. 2013-135298, and translation of substantive portions thereof.

Forte, Ian "DeWalt Studio Fall 2011" Coroflot dated Oct. 16, 2011 [online] [retrieved on Nov. 6, 2017]—retrieved from URL: www.coroflot.com/ian/forte/dewalt-studio-fall-2011.

Office Action from the Chinese Patent Office dated Sep. 18, 2017 in related Chinese application No. 201480036244.3, and machine translation thereof.

Office Action from the Chinese Patent Office dated Sep. 20, 2016 in related Chinese application No. 01480036244.3, and translation of substantive portions thereof.

Office Action from the Japanese Patent Office dated Feb. 26, 2019 in counterpart Japanese application No. 2018-084351 with examined claims 1-4, and machine translations thereof.

* cited by examiner

SCREW-TIGHTENING POWER TOOL

CROSS-REFERENCE

This application is the U.S. National Stage of International Application No. PCT/JP2014/054682 filed on Feb. 26, 2014, which claims priority to Japanese patent application no. 2013-135298 filed on Jun. 27, 2013.

TECHNICAL FIELD

The present invention generally relates to screw-tightening power tools.

BACKGROUND ART

As disclosed in Japanese Laid-open Patent Publication 2010-46739, a known screw-tightening power tool comprises a rotary-drive part having, at a front-end part of a housing that houses a motor, a first spindle rotationally driven by the motor and a second spindle configured to hold a tip tool (tool accessory). The rotary-drive part is configured to tighten a screw by transmitting rotational energy from the first spindle to the second spindle when the second spindle is in a retracted position.

SUMMARY

In the above-mentioned, known screw-tightening power tool, a commutator motor is used as the motor; however, this causes a durability problem owing to wear of brushes and also impedes design efforts to make the tool more compact.

Accordingly, in one aspect of the present teachings, a screw-tightening power tool is disclosed that has suitable durability while also being designable in a more compact manner.

According to another aspect of the present teachings, a screw-tightening power tool is disclosed that preferably comprises: a housing; a brushless motor comprising: a stator fixed to the housing; and a rotor that is rotatable relative to the stator; a tip-tool retaining part (e.g. a chuck) configured to hold a tool bit (tool accessory); a clutch disposed between the rotor and the tip-tool retaining part; and a battery pack detachably fixed to a lower part of the housing; wherein, the brushless motor is disposed downward of the clutch.

According to another aspect of the present teachings, a control circuit board is provided upward of the battery pack; a light is disposed forward of the brushless motor; and the light and the control circuit board are connected by a cord.

According to another aspect of the present teachings, a screw-tightening power tool is disclosed that preferably comprises: a motor housing; a brushless motor comprising: a stator fixed to the motor housing; and a rotor rotatable with respect to the stator; a tip-tool retaining part capable of holding a bit; a clutch disposed between the rotor and the tip-tool retaining part; a grip housing extending from the motor housing; a switch assembly provided in the grip housing; and a trigger held by the switch assembly; wherein, a sensor-circuit board is provided such that it is fixed with respect to the stator; the sensor-circuit board and the switch assembly are connected by a cord; and the stator and the switch assembly are connected by a cord.

According to another aspect of the present teachings, a cooling fan is provided between the stator and the clutch.

According to another aspect of the present teachings, a light connected to the switch assembly by a cord is provided.

According to another aspect of the present teachings, a screw-tightening power tool is disclosed that preferably comprises: a housing; a brushless motor comprising: a stator fixed to the housing; and a rotor rotatable with respect to the stator; a tip-tool retaining part capable of holding a bit; a clutch disposed between the rotor and the tip-tool retaining part; and a battery pack fixed to a lower part of the housing; and wherein, a control circuit board is provided upward of the battery pack; and a light switch electrically connected to the control circuit board and for modifying an illumination mode of a light is provided.

According to another aspect of the present teachings, a screw-tightening power tool is disclosed that preferably comprises: a housing; a brushless motor comprising: a stator fixed to the housing; and a rotor rotatable with respect to the stator; a tip-tool retaining part capable of holding a bit; a clutch disposed between the rotor and the tip-tool retaining part; and a battery pack fixed to a lower part of the housing; wherein, a control circuit board is provided upward of the battery pack; and a remaining-capacity-display switch electrically connected to the control circuit board and for displaying the remaining capacity of the battery pack is provided.

According to another aspect of the present teachings, a cord that supplies electricity to a coil of the brushless motor is connected via an insulating member provided on the stator.

According to at least some aspects of the present teachings, by utilizing a brushless motor, it is possible to increase motive-power-transmission efficiency while also achieving compact designs, thereby enabling screw tightening operations at relatively low power. In addition, durability is also improved because brushes are not used.

Exemplary embodiments of the present teachings are described below, with reference to the drawings.

First Embodiment

Figure 1:
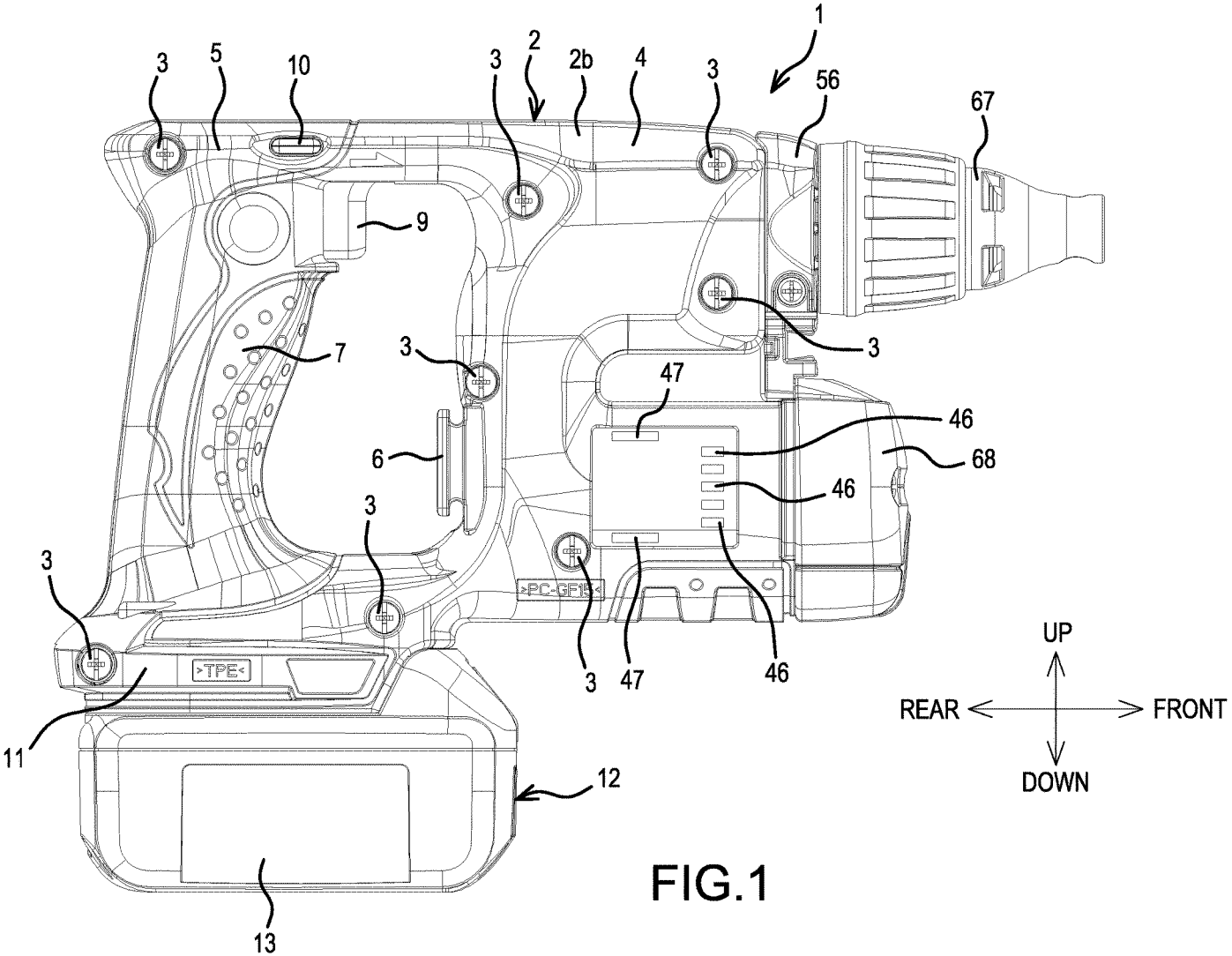
FIG. 1 is an external view of a screwdriver of a first embodiment.
Figure 2:
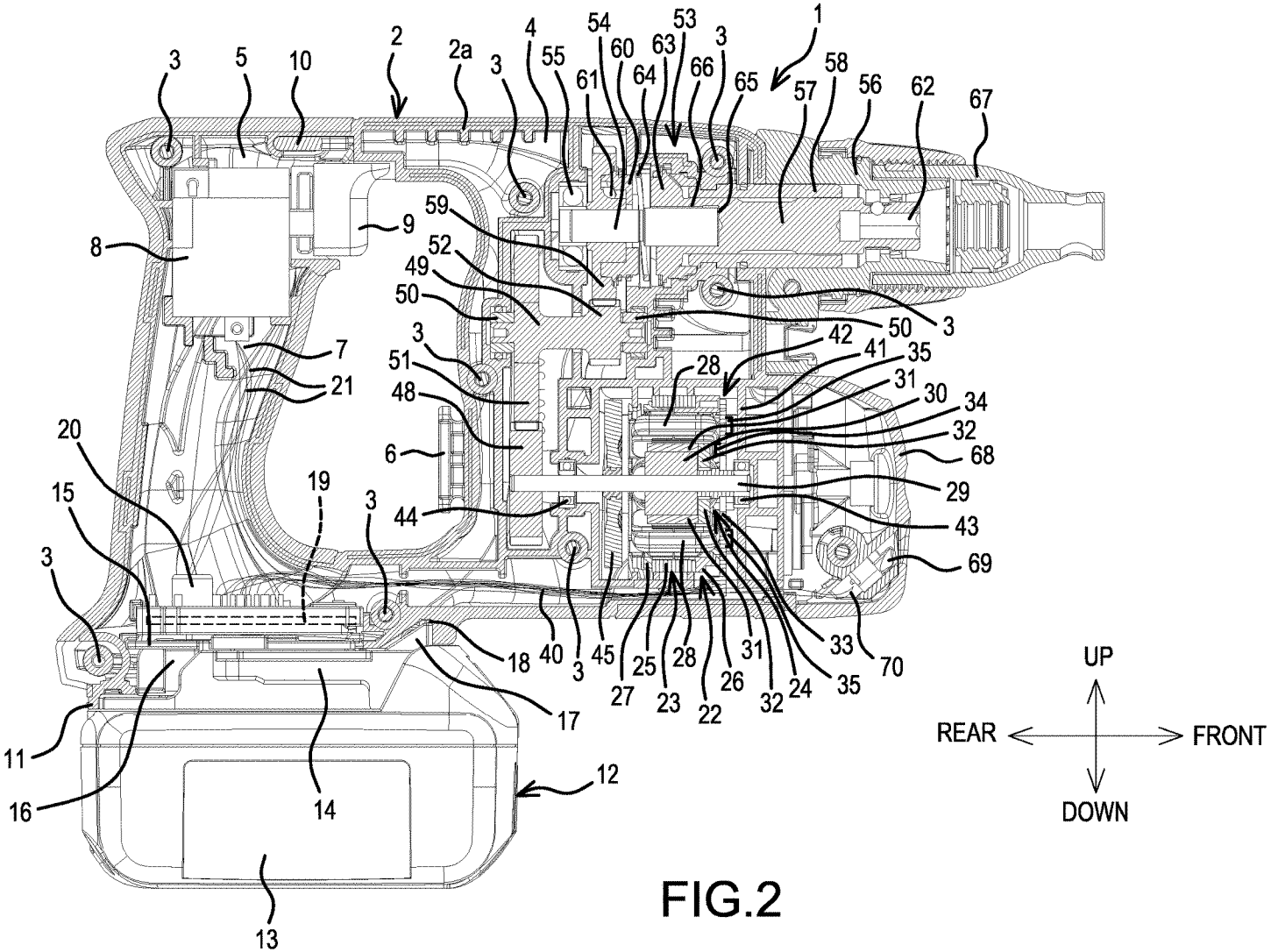
FIG. 2 is a longitudinal cross-sectional view of the screwdriver of the first embodiment.

In the housing 2 of the screwdriver 1 shown in FIGS. 1 and 2, left and right half housings 2*a*, 2*b* are assembled (joined) together by a plurality of screws 3, thereby forming a front housing 4 (right sides in FIGS. 1, 2 are forward), which houses an output part 53 and a brushless motor 22 described below, and a rear housing 5, which is coupled in a loop rearward of the front housing 4. A hook 6 is provided on a rear surface of the front housing 4. A grip part (grip) 7 is formed in an up-down direction at a rear end of the rear housing 5, and a trigger switch 8, from which a trigger 9 projects forward, is housed inside the grip part 7. A forward/reverse switching button 10 is provided upward of the trigger switch 8.

In addition, a battery pack 12, which serves as (constitutes) a power supply, is attachably and detachably mounted to a mounting part 11, which is formed downward of the grip part 7. The battery pack 12 comprises a pair of left and right sliding rails 14 located on an upper surface of a case 13 that houses a plurality of storage batteries, and the battery pack 12 is capable of being mounted to the mounting part 11 by mating, from the rear, the sliding rails 14 to and in between a pair of guide rails (not shown) provided on the mounting part 11 and then sliding the sliding rails 14, 14 rearward. In this mounted state, a terminal plate 16 of a terminal block 15 provided in the mounting part 11 advances into the case 13 and is electrically connected with terminals (not shown) located inside the case 13. A latching hook 17 is provided inside the case 13 such that it protrudes therefrom and is biased upward so as to latch in a recessed part 18, which is provided in the mounting part 11, in the mounted state, whereby the battery pack 12 is latched/locked to the mounting part 11.

Furthermore, a control circuit board 19, which is molded from a resin material and on which a capacitor 20, a microcontroller 71 (see FIG. 4), etc., are installed, is provided on an upper side of the terminal block 15. The control circuit board 19 and the trigger switch 8 are electrically connected via respective cords 21.

Figure 3:
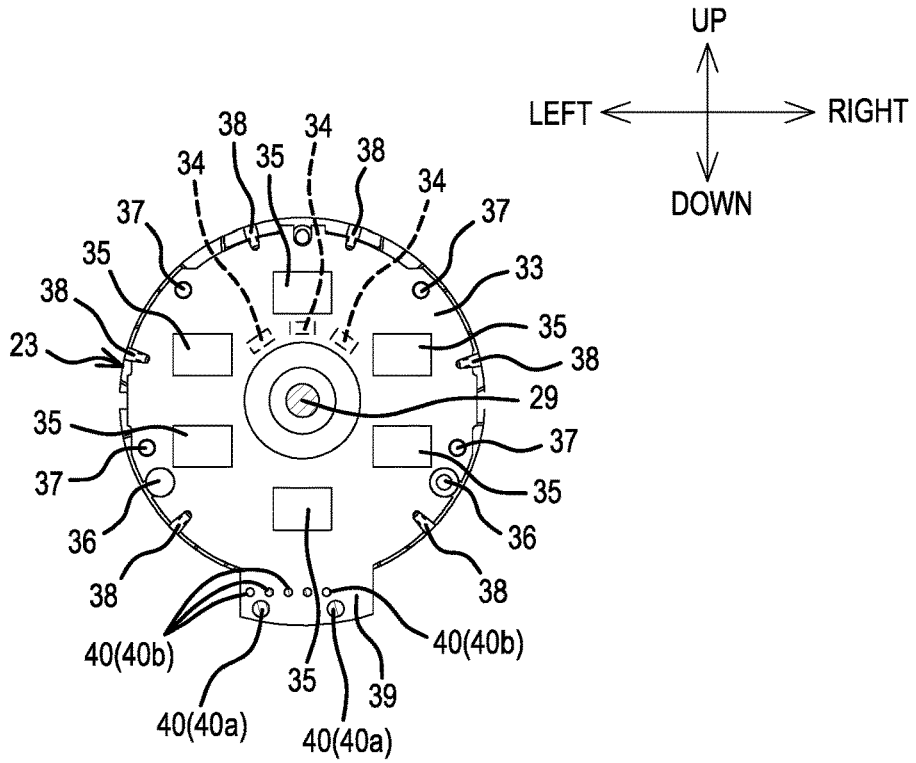
FIG. 3 is an explanatory diagram of a sensor-circuit board.

The brushless motor 22 is an inner-rotor-type motor that comprises a stator 23 and a rotor 24, and is disposed on a lower side of the front housing 4. The stator 23 comprises a stator core 25. A front insulating member 26 and a rear insulating member 27 are respectively provided forward and rearward of the stator core 25. A plurality of coils 28 are wound around the stator core 25 via the front insulating member 26 and the rear insulating member 27. In addition, the rotor 24 comprises a rotary shaft 29 located at an axial center. A tubular rotor core 30 is disposed around the rotary shaft 29. Tubular permanent magnets 31 are disposed on an outer side of the rotor core 30 and their respective polarities alternate in a circumferential direction. A plurality of sensor permanent magnets 32 is disposed radially on a front side thereof. As shown in FIG. 3, three rotation-detection devices 34, which detect the positions of the sensor permanent magnets 32 of the rotor 24 and output rotation-detection signals, as well as six switching devices 35, which switch the coils 28, are mounted on a sensor-circuit board 33, which is fixed to a front end of the front insulating member 26. Screws 36 affix the sensor-circuit board 33 to the motor 22. Projections 37 are provided such that they project from a front end surface of the front insulating member 26 and mate with small holes defined in the sensor-circuit board 33. The sensor-circuit board 33 also includes coil-connection parts 38 and a tongue part 39, which is provided such that it projects and faces downward. A plurality of cords 40 (including power-supply lines 40*a* for conducting electric current from the control circuit board 19 and signal lines 40*b* for transmitting signals from the control circuit board 19), which provide electrically connections with the control circuit board 19, is connected to the tongue part 39.

Furthermore, the stator 23 is held, with an attitude such that its axis line (axial extension) is oriented in the front-rear direction, inside a chamber 42 formed by ribs 41 uprightly provided on an inner surface of the front housing 4. The rotary shaft 29 is rotatably supported by a first bearing 43, which is held by the rib 41 on the front side of the chamber 42, and by a second bearing 44, which is held by the rib 41 on a rear side of the chamber 42. A centrifugal fan 45 for cooling the motor is securely mounted forward of the bearing 44 on the rotary shaft 29. A plurality of air-suction ports 46 is formed in an outer-side region in the radial direction of the sensor-circuit board 33 in the front housing 4. Moreover, a plurality of air-exhaust ports 47 is formed in an outer-side region in the radial direction of the centrifugal fan 45.

Furthermore, a rear end of the rotary shaft 29 protrudes rearward from the chamber 42 and a first gear 48 is securely mounted thereon. Upward of the rotary shaft 29, a gear shaft 49 is axially supported, parallel to the rotary shaft 29, by front and rear bearings 50, 50, and a second gear 51, which is provided at a rear end of the gear shaft 49, meshes with the first gear 48. A third gear 52, the diameter of which is smaller than that of the second gear 51, is formed at a front end of the gear shaft 49.

Furthermore, the output part 53 is disposed upward of the brushless motor 22. The output part 53 comprises: a first spindle 54, which is axially supported, via a bearing 55, by the front housing 4; and a second spindle 57, which is provided such that it extends from the front housing 4 to a tubular tip housing 56 coupled forward of the front housing 4, that serves as a tip-tool retaining part (chuck) axially supported via a bearing 58. A fourth gear 59 is integrally and securely mounted to a rear part of the first spindle 54, and the fourth gear 59 is meshed with the third gear 52 of the gear shaft 49. In addition, a cam 60 is integrally joined (operably connected), in a rotational direction, to the front of the fourth gear 59 via a ball 61.

Moreover, the second spindle 57 is coaxially disposed forward of the first spindle 54 such that it is capable of forward-rearward movement. A mount hole 62 designed to receive/hold a driver bit (tip tool or tool accessory) is formed at a front end of the second spindle 57. A cam part 63, which opposes the cam 60, is formed at a rear end of the second spindle 57. The cam part 63 meshes with the cam 60 in the forward rotational direction, and therefore a coil spring 64 is interposed between the cam 60 and the cam part 63. That is, a clutch (cam 60, cam part 63), through which the rotation of the second spindle 57 is transmitted when the first spindle 54 is in a retracted state (position), is formed between the first spindle 54 and the second spindle 57.

Furthermore, a tip of the first spindle 54 is inserted into a bottomed hole 65, which is formed in a rear part of the second spindle 57; a one-way clutch 66, which engages in a reverse rotational direction, is provided between the two spindles 54, 57. A cap 67 is provided for adjusting the depth with which a front-rear position thereof is modifiably (movably) fitted to a front end of the tip housing 56.

In addition, a cap-shaped cover housing 68 is fixed to a front-end lower part of the front housing 4 forward of the brushless motor 22. An LED 69, which serves as a light source, is housed, with an attitude such that it faces diagonally frontward, downward inside the cover housing 68 and is electrically connected to the control circuit board 19 via a cord 70.

In the screwdriver 1 configured as described above, when the driver bit mounted in the second spindle 57 is pressed against a screw-to-be-tightened and the second spindle 57 is retracted, the cam part 63 engages with the cam 60 of the first spindle 54. When the trigger switch 8 is turned ON by manually depressing the trigger 9 in this state, power is supplied from the battery pack 12, and thereby the brushless motor 22 is driven. That is, the microcontroller of the control circuit board 19 acquires the rotational state of the rotor 24 by receiving rotation-detection signals, which are output from the rotation-detection devices 34 of the sensor-circuit board 33 and indicate the positions of the sensor permanent magnets 32 of the rotor 24, sequentially supplies electric current to each of the coils 28 of the stator 23 by controlling the ON/OFF state of each of the switching devices 35 in accordance with the acquired rotational state, and thereby causes the rotor 24 to rotate. However, an amount of manipulation (press-in amount) of the trigger 9 is transmitted as a signal to the microcontroller, and the rotation of the rotor 24 is controlled in accordance with the amount of manipulation. Furthermore, another method of use is also possible in which the second spindle 57 is caused (pushed) to retract after the trigger 9 has been depressed and the brushless motor 22 has already started to rotate.

Thus, when the rotor 24 rotates, the rotary shaft 29 and the first gear 48 rotate and the gear shaft 49 is rotated via the second gear 51 at a slower speed; furthermore, the first spindle 54 is rotated via the third gear 52 and the fourth gear 59 at a slower speed. Thereby, the second spindle 57, which engages with the cam 60, rotates, enabling the driver bit to perform a screw tightening operation. As the screw tightening progresses, the second spindle 57 advances, and, when the cam part 63 disengages from the cam 60, the rotation of the second spindle 57 stops and the screw tightening operation terminates.

Moreover, when loosening a screw, the forward/reverse switching button 10 is switched to the reverse-rotation side, whereby the rotor 24 rotates in reverse under the control of the microcontroller, and the first spindle 54 rotates in reverse. Because the one-way clutch 66 is provided between the first spindle 54 and the second spindle 57, the second spindle 57 also rotates in reverse, enabling the driver bit to loosen the screw.

Furthermore, when the centrifugal fan 45 rotates together with the rotary shaft 29, air drawn from the air-suction ports 46 into the chamber 42 passes between the sensor-circuit board 33 and the stator 23 and between the sensor-circuit board 33 and the rotor 24 and is discharged from the air-exhaust ports 47. Thereby, the sensor-circuit board 33 and the brushless motor 22 are cooled.

In addition, upon turning ON the trigger switch 8, the LED 69 is energized by the control circuit board 19 and turns ON. Thereby, the area forward of the driver bit is illuminated and thus work efficiency can be maintained even in a dark location.

Furthermore, the brushless motor 22 and the LED 69 are proximate to one another, which simplifies the wiring.

Thus, according to the screwdriver 1 of the above-described first embodiment, by utilizing the brushless motor 22, it is possible to increase motive-power-transmission efficiency in a compact design, thereby enabling screw tightening at a relatively low power. In addition, durability is also improved because brushes are not used.

Furthermore, because the brushless motor 22 is disposed downward of the clutch, the brushless motor 22 is balanced with respect to the battery pack 12 to the rear, thereby excelling ergonomically.

In addition, because the sensor-circuit board 33 is not sandwiched between the brushless motor 22 and the first gear 48 and the like, durability can be further increased due to the additional spatial separation from the heat, vibration, etc. of the motor 22.

Furthermore, because the tongue part 39 of the sensor-circuit board 33 is formed such that it faces downward, an efficient wiring arrangement from the control circuit board 19 to the tongue part 39 is possible.

Figure 4:
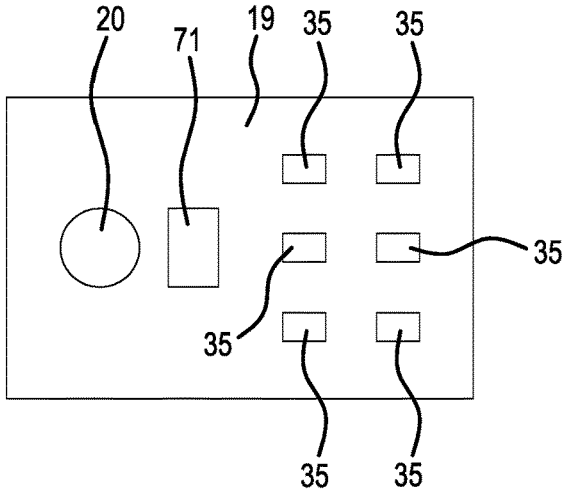
FIG. 4 is an explanatory diagram of a modified example of a control circuit board.

Furthermore, in the above-described first embodiment, although the switching devices 35 are provided on the sensor-circuit board 33, they can also be provided on the control circuit board 19, as shown in FIG. 4.

In addition, the speed-reducing mechanism from the rotary shaft to the first spindle likewise can be suitably modified; for example, the number of gear shafts can be increased, the gear shafts conversely can be omitted, or the like.

In the following, other embodiments of the present teachings will be described. However, constituent parts (structural elements) identical to those in the above-described first embodiment are assigned the same reference numbers, and redundant explanations thereof are omitted.

Second Embodiment

Figure 5:
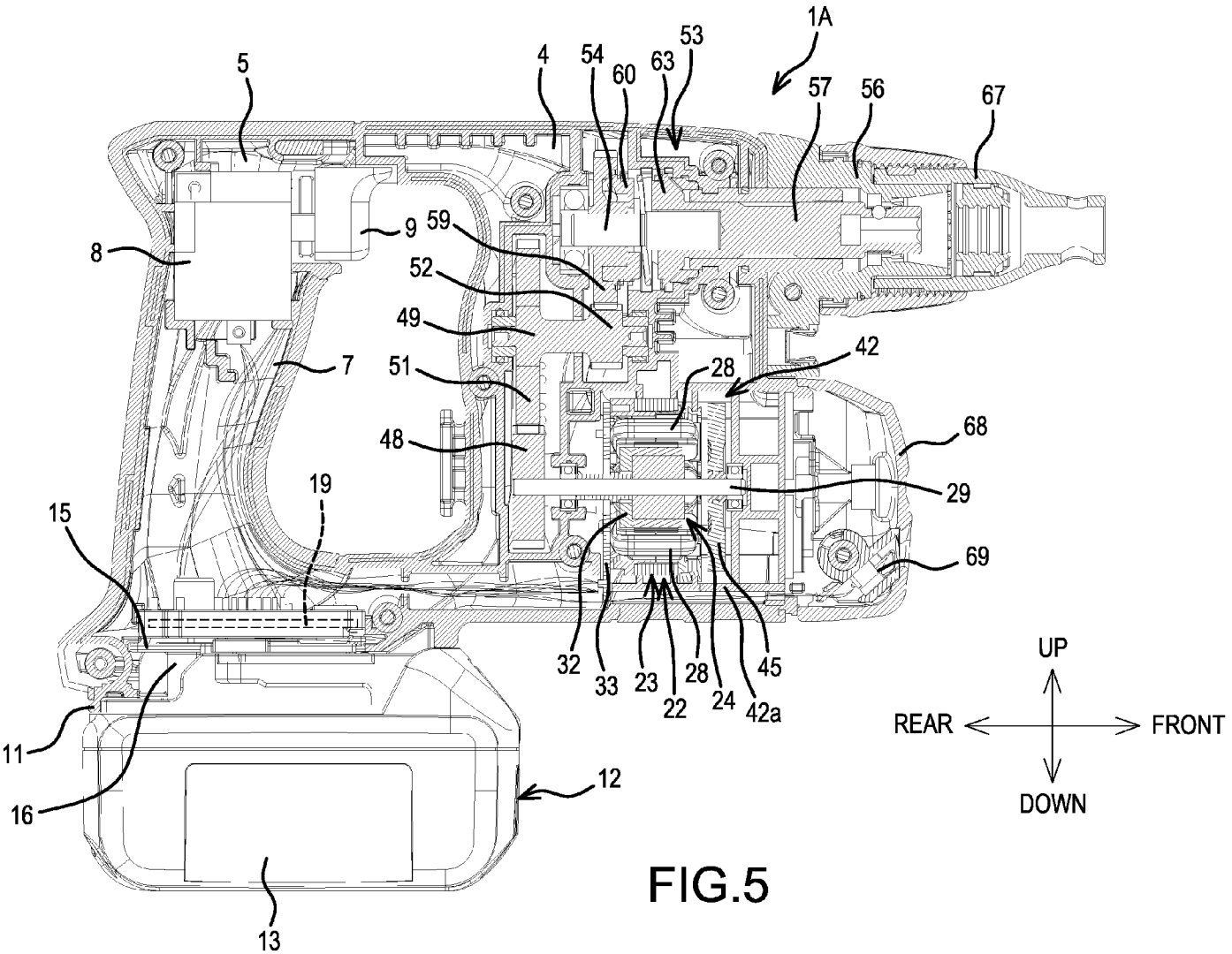
FIG. 5 is a longitudinal cross-sectional view of the screwdriver of a second embodiment.

The screwdriver 1A shown in FIG. 5 differs from the first embodiment in that the orientation of the brushless motor 22 is reversed in the front-rear direction, the sensor-circuit board 33 is located on the rear side of the stator 23, and the centrifugal fan 45 is located on the front side of the stator 23. Consequently, in this embodiment, the air-suction ports 46 are disposed on the rear side of the housing 2, and the air-exhaust ports 47 are disposed on the front side of the housing 2.

In addition, a partition part 42*a* spaces apart (isolates) the cord 70 for the LED 69 from the outer circumference of the centrifugal fan 45, which makes it possible to supply the draft (air flow) from the centrifugal fan 45 more efficiently.

Thus, in the screwdriver 1A of the above-described second embodiment, too, by utilizing the brushless motor 25, it is possible to increase motive-power-transmission efficiency while achieving a compact design, thereby enabling screw tightening at a relatively low power. In addition, other effects the same as those in the first embodiment are obtained, such as the improvement of durability because brushes are not used.

In particular, the sensor-circuit board 33 is closer to the control circuit board 19 than it is in the first embodiment, which is advantageous because a shorter run of wiring is possible.

Third Embodiment

Figure 6:
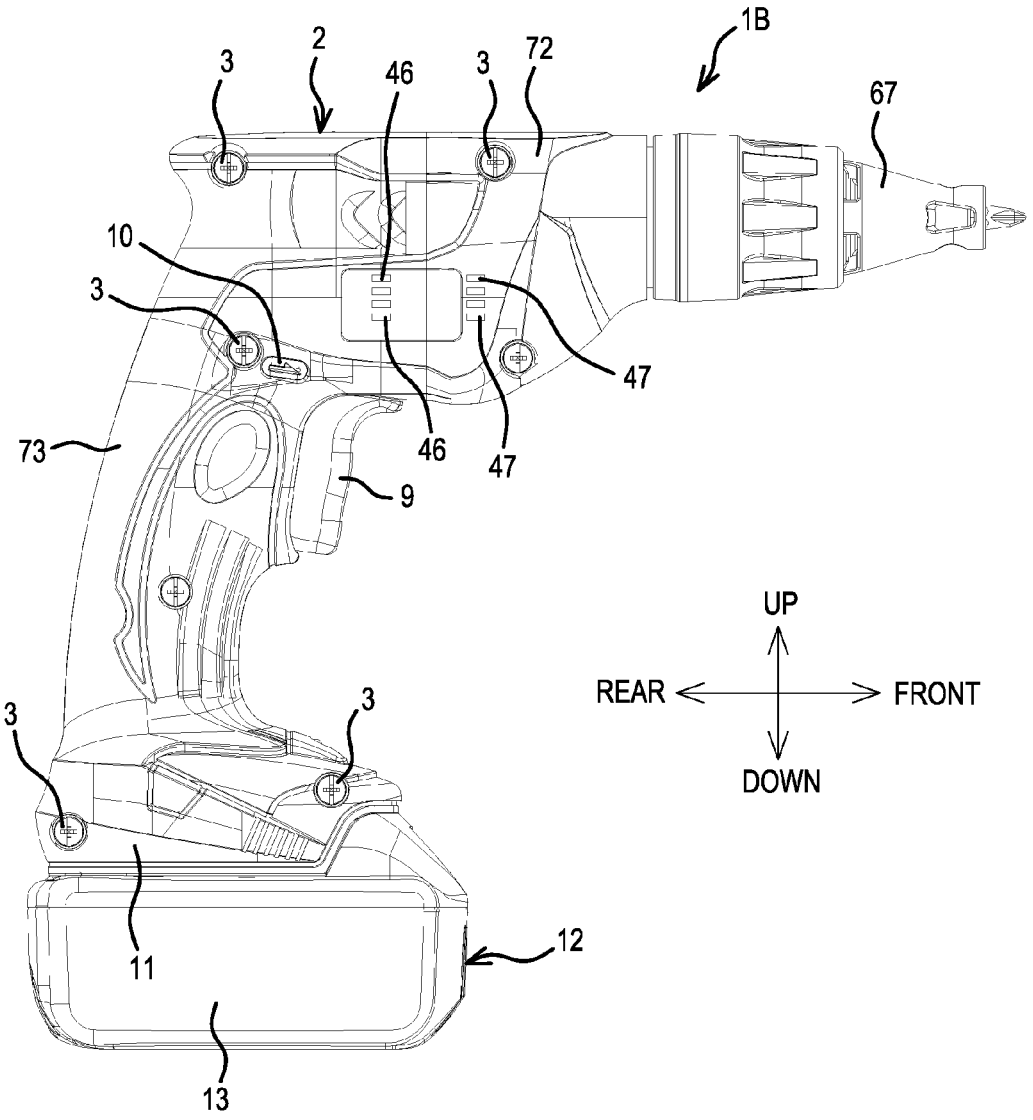
FIG. 6 is an external view of the screwdriver of a third embodiment.
Figure 7:
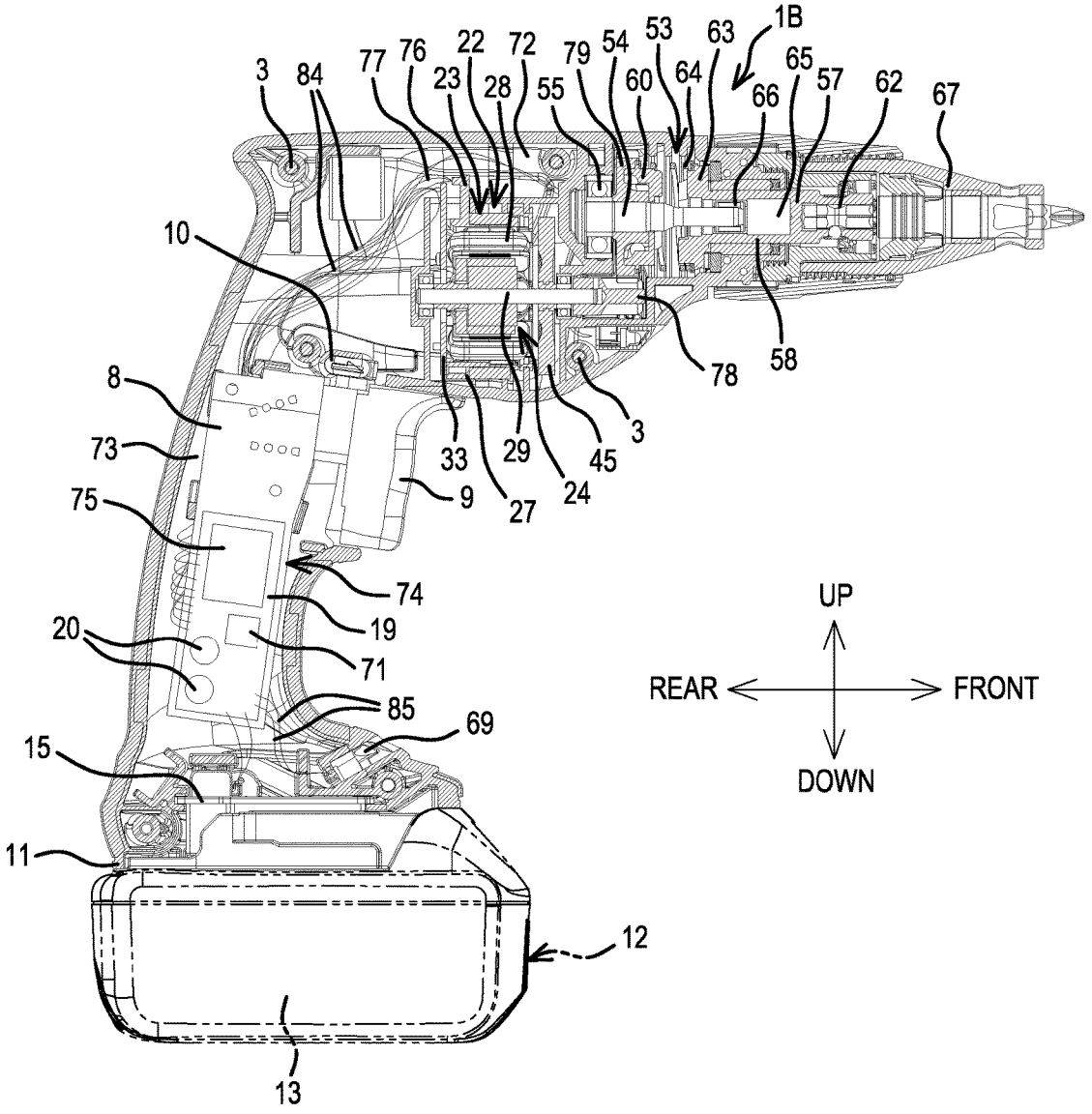
FIG. 7 is longitudinal cross-sectional view of the screwdriver of the third embodiment.

In the screwdriver 1B shown in FIGS. 6, 7, the housing 2 has an L-shape overall and comprises: a motor housing 72, which houses the brushless motor 22 and the output part 53 and extends in the front-rear direction, and a grip housing 73, which extends from a rear end of the motor housing 72 in the downward direction. Furthermore, the mounting part 11 of the battery pack 12 is formed at a lower end of the grip housing 73. The LED 69 is housed, upward of the terminal block 15, such that it faces diagonally upward from the mounting part 11.

In addition, in this embodiment, the control circuit board 19 is provided integrally with a lower part of the trigger switch 8 to form a switch assembly 74. The control circuit board 19 of the switch assembly 74 and the sensor-circuit board 33 are electrically connected via respective cords 84. In addition, the control circuit board 19 and the LED 69 are electrically connected via respective cords 85, 85. The control circuit board 19 is equipped with an IPM (Intelligent Power Module) 75 in addition to the microcontroller 71, the capacitors 20, etc. The IPM contains switching devices (IGBTs) and is encapsulated with a driver for driving the switching devices.

Furthermore, in the brushless motor 22, a connecting piece 76 protrudes toward the outer side in the radial direction and is provided on the rear insulating member 27 of the stator 23 such that it protrudes therefrom. A cord 77 supplies electric power (current) to the coils 28 and is connected to the coils 28 through the connecting piece 76.

Furthermore, a pinion 78 is securely mounted to a front end of the rotary shaft 29, and the pinion 78 directly meshes with the first spindle 54 and an integrated gear 79.

Thus, in the screwdriver 1B of the above-described third embodiment, too, by utilizing the brushless motor 22, it is possible to increase motive-power-transmission efficiency in a compact design, thereby enabling screw tightening at a relatively low power. In addition, other effects the same as those in the first embodiment are obtained, such as the improvement of durability because brushes are not used.

In particular, the switch assembly 74 of the present embodiment is advantageous because the time and labor needed for assembly are reduced and the wiring procedure is easier because the wiring is concentrated in one location.

Furthermore, because the centrifugal fan 45 is located between the brushless motor 22 and the gear 79, direct and indirect cooling of the gear 79 is also possible, in addition to the cooling of the brushless motor 22.

Furthermore, although the positional information of the rotor 24 is output from the sensor-circuit board 33 via the signal lines 40*b*, the sensor-circuit board 33 is located on the rear side, and therefore the connection to the control circuit board 19 is easy. In addition, because the connecting piece 76 of the rear insulating member 27 is also on the rear side, the connection to the control circuit board 19 is easy.

Fourth Embodiment

Figure 8:
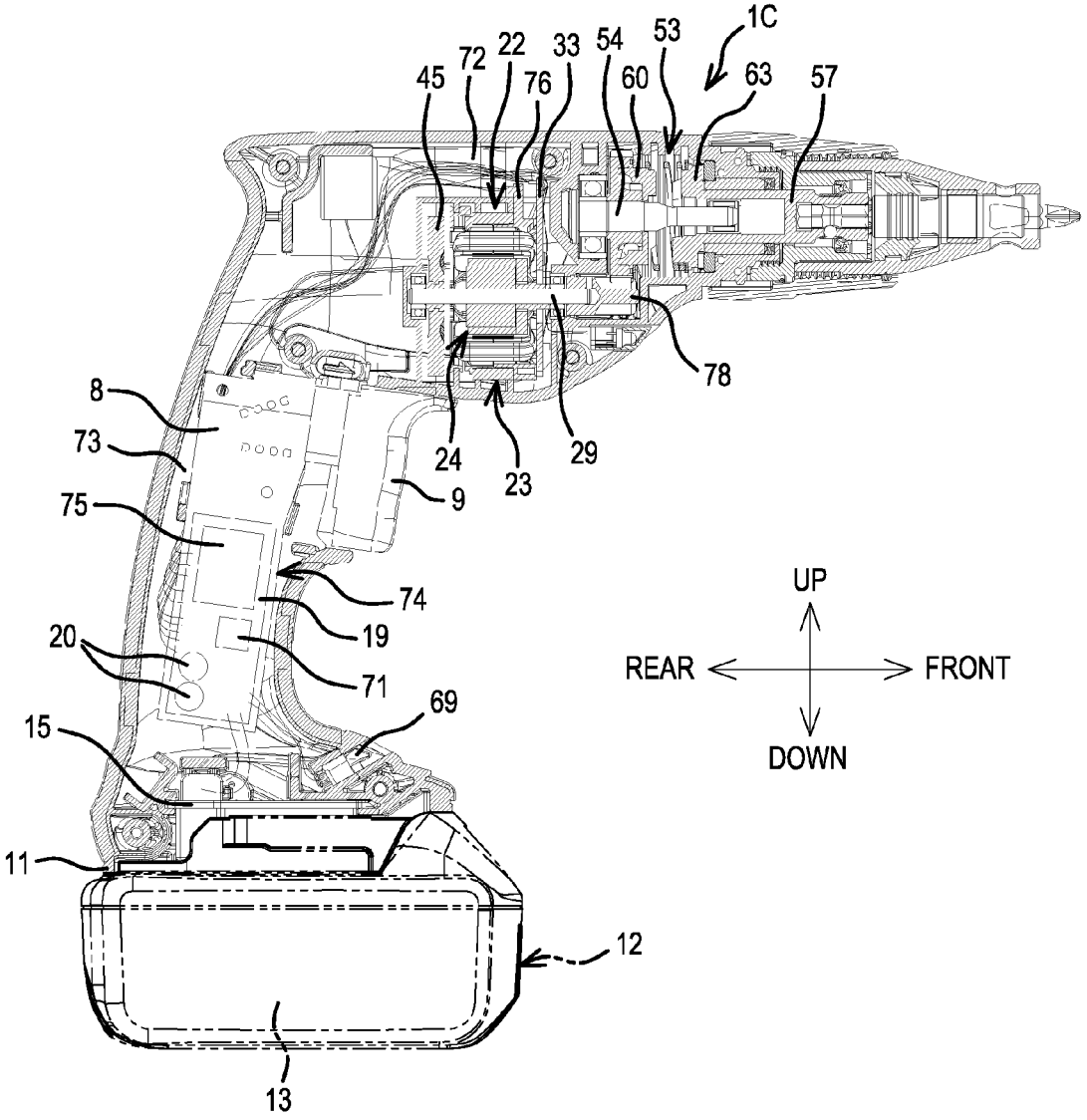
FIG. 8 is a longitudinal cross-sectional view of the screwdriver of a fourth embodiment.

In the screwdriver 1C shown in FIG. 8, the orientation of the brushless motor 22 is the reverse in the front-rear direction of that of the third embodiment, and therefore the sensor-circuit board 33 is on the front side and the centrifugal fan 45 is on the rear side.

Consequently, in the screwdriver 1C of the above-described fourth embodiment, too, the same functions and effects as the preceding embodiments can be achieved.

Fifth Embodiment

Figure 9:
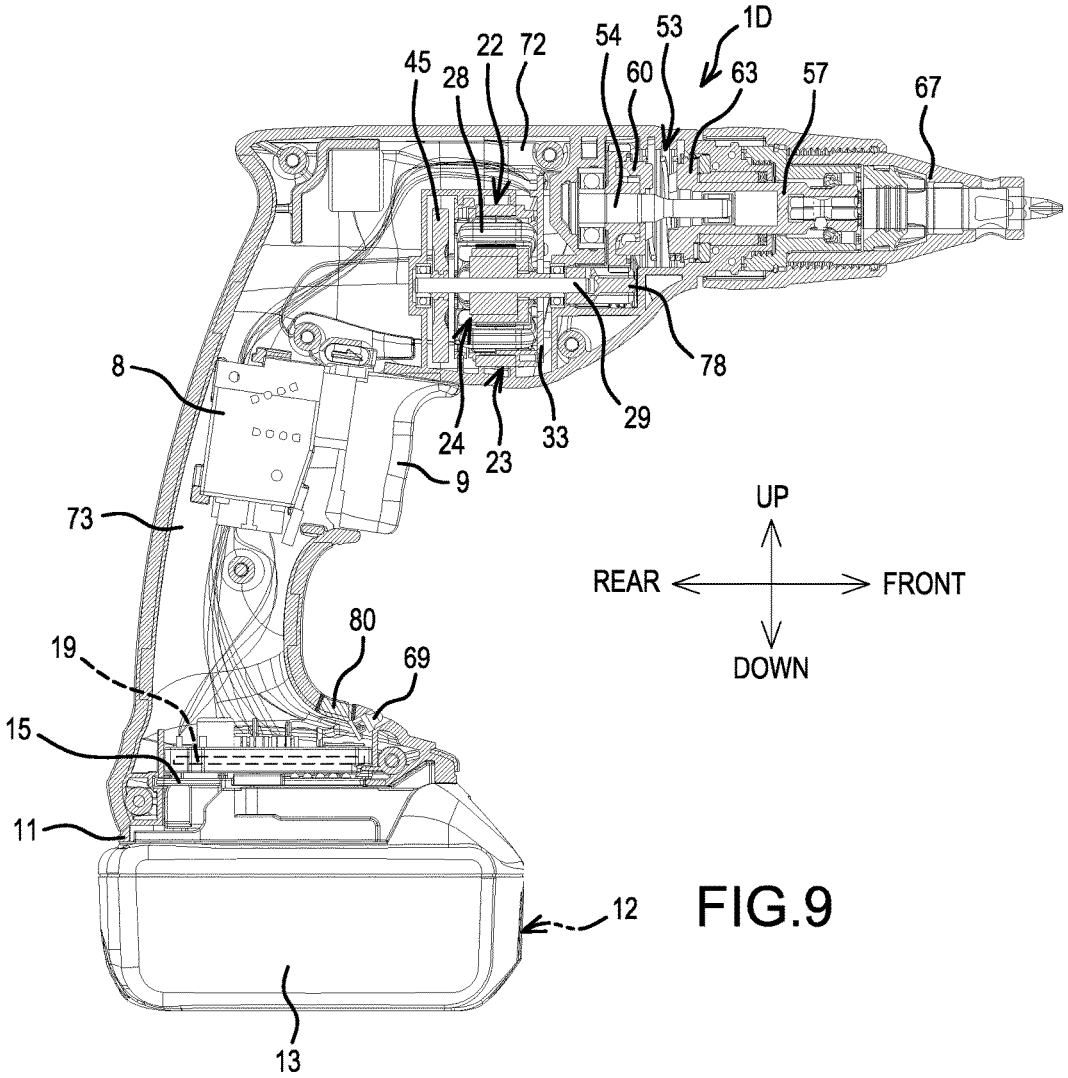
FIG. 9 is a longitudinal cross-sectional view of the screwdriver of a fifth embodiment.

In the screwdriver 1D shown in FIG. 9, the control circuit board 19 is not provided on the trigger switch 8, but rather is provided above the terminal block 15 as in the first embodiment. Therefore, power is supplied to the coils 28 via the sensor-circuit board 33, not via the insulating members.

Figure 10:
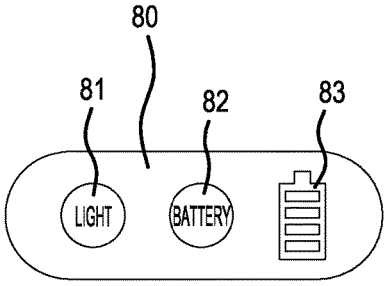
FIG. 10 is an explanatory diagram of an operation panel.

In addition, in the present embodiment, an operation panel 80, as shown in FIG. 10, is provided on an upper surface of the mounting part 11 and rearward of the LED 69. The operation panel 80 is provided with a light switch 81, a remaining-battery-capacity-display switch 82, and a battery indicator 83, and is electrically connected to the control circuit board 19. Furthermore, the luminous flux intensity (light output) of the LED 69 changes in steps every time the light switch 81 is pressed. When the remaining-battery-capacity-display switch 82 is pressed, the battery indicator 83 lights up a number of gradations in accordance with the remaining battery capacity (amount of charge) of the battery cells of the battery pack 12.

Thus, in the screwdriver 1D of the above-described fifth embodiment, the same functions and effects as the preceding embodiments can be achieved.

In addition, the illumination mode (output) of the LED 69 can be changed by the light switch 81, and the remaining battery capacity of the battery can be observed by depressing the remaining-battery-capacity-display switch 82, thereby excelling in user-friendliness.

Sixth Embodiment

Figure 11:
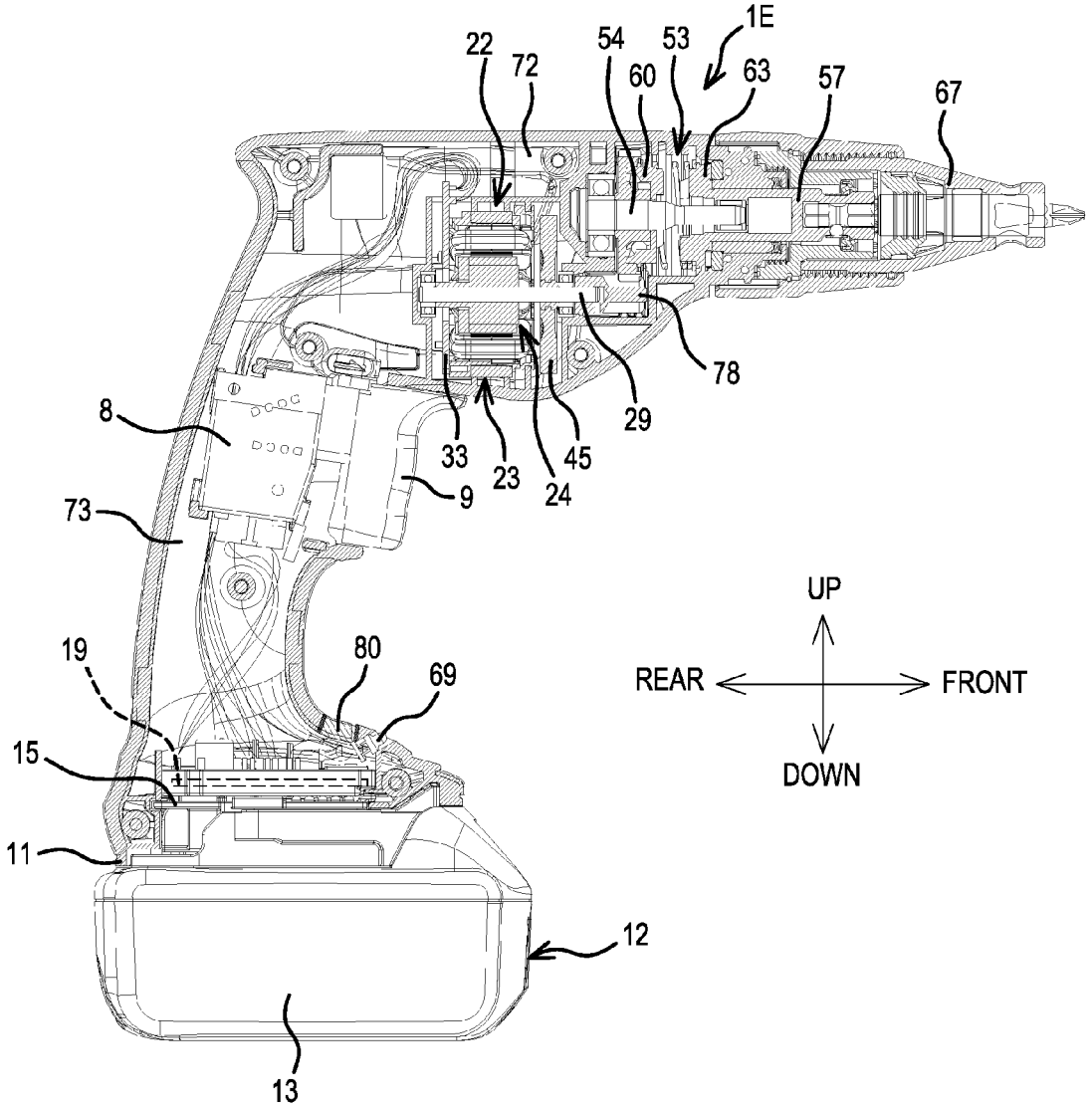
FIG. 11 is a longitudinal cross-sectional view of the screwdriver of a sixth embodiment.

In the screwdriver 1E shown in FIG. 11, the orientation of the brushless motor 22 is the reverse in the front-rear direction of that in the fifth embodiment; that is, the sensor-circuit board 33 is on the rear side and the centrifugal fan 45 is on the front side.

Consequently, in the screwdriver 1E of the above-described sixth embodiment, too, the same functions and effects as the preceding embodiments can be achieved.

Furthermore, because the sensor-circuit board 33 is located on the rear side, this design is advantageous because the wiring run (distance) is shorter than in the fifth embodiment.

Furthermore, in common with the third through sixth embodiments, the reduction of speed from the rotary shaft to the first spindle is performed by the pinion and the gear, but it is also possible to achieve a reduction in speed with a planetary-gear mechanism disposed coaxially with the rotary shaft and the first spindle.

In addition, the switch assembly of the third embodiment, the operation panel of the fifth embodiment, and the like can also be utilized in a screwdriver of the type described in the first and second embodiments.

EXPLANATION OF THE REFERENCE NUMBERS

1, 1A-1E Screwdriver
2 Housing
4 Front housing
5 Rear housing
8 Trigger switch
11 Mounting part
12 Battery pack
15 Terminal block
19 Control circuit board
22 Brushless motor
23 Stator
24 Rotor
25 Stator core
26 Front insulating member
27 Rear insulating member
28 Coil
29 Rotary shaft
30 Rotor core
31 Permanent magnet
32 Sensor permanent magnet
33 Sensor-circuit board
34 Rotation-detection device
35 Switching device
42 Chamber
45 Centrifugal fan
49 Gear shaft
53 Output part
54 First spindle
57 Second spindle
60 Cam

63 Cam part
71 Microcontroller
74 Switch assembly
80 Operation panel
81 Light switch
82 Remaining-battery-capacity-display switch

The invention claimed is:

1. A screw-tightening power tool, comprising:
a motor housing;
a grip housing downwardly extending from a lower part of the motor housing;
a brushless motor comprising: a stator fixed to the motor housing and a rotor that is rotatable relative to the stator, a rotary shaft being attached to the rotor;
a tip-tool retaining part configured to hold a bit;
a clutch disposed between the rotor and the tip-tool retaining part in an axial direction of the power tool, the clutch comprising a cam releasably meshing with a cam part;
a cooling fan disposed between the stator and the clutch in the axial direction;
a battery mounting part disposed at a lower part of the grip housing;
a battery pack detachably affixed to the battery mounting part;
an LED located on an upper portion of the battery mounting part;
a trigger that protrudes from the grip housing;
a trigger switch disposed within the grip housing;
a pinion securely mounted to a front end of the rotary shaft and directly meshing with an integrated gear fixed to a first spindle; and
a coil spring interposed between the cam and the cam part;
wherein the clutch has a rotational axis,
a rotational axis of the rotary shaft is disposed between the rotational axis of the clutch and the lower part of the grip housing in a direction perpendicular to the axial direction, and
the rotational axis of the rotary shaft extends in parallel to the rotational axis of the clutch.

2. The screw-tightening power tool according to claim 1, wherein:
a trigger switch assembly that includes the trigger switch is provided in the grip housing;
the trigger is held by the trigger switch assembly;
a sensor-circuit board is fixed to the stator;
the sensor-circuit board and the trigger switch assembly are connected by a first cord; and
the stator and the trigger switch assembly are electrically connected by a second cord.

3. The screw-tightening power tool according to claim 2, wherein the LED is configured to provide illumination and is connected to the switch assembly by a third cord.

4. The screw-tightening power tool according to claim 2, wherein the second cord is configured to supply electrical current to a coil of the brushless motor and is connected via an insulating member provided on the stator.

5. The screw-tightening power tool according to claim 1, wherein a sensor-circuit board is located on a rear side of the rotor in the axial direction and the clutch is disposed forward of the rotor in the axial direction.

6. The screw-tightening power tool according to claim 2, wherein a control circuit board is provided integrally with a lower part of the trigger to form the trigger switch assembly.

7. The screw-tightening power tool according to claim 1, further comprising a control circuit board disposed in the motor housing between the motor and a lower part of the motor housing in the direction perpendicular to the axial direction, the control circuit board being equipped with an Intelligent Power Module, a microcontroller and capacitors.

8. The screw-tightening power tool according to claim 7, wherein the Intelligent Power Module contains switching devices and a driver for driving the switching devices.

9. The screw-tightening power tool according to claim 1, wherein the LED faces diagonally from the upper portion of the battery mounting part toward the tip-tool retaining part.

10. The screw-tightening power tool according to claim 1, wherein:
the tip-tool retaining part comprises a second spindle that is coaxially disposed forward of the first spindle such that it is capable of forward-rearward movement,
a mount hole configured to receive the bit is defined at a front end of the second spindle, and
the cam part is defined at a rear end of the second spindle.

11. The screw-tightening power tool according to claim 10, wherein a sensor-circuit board is located on a rear side of the rotor in the axial direction and the clutch is disposed forward of the rotor in the axial direction.

12. The screw-tightening power tool according to claim 11, wherein a control circuit board is provided integrally with a lower part of the trigger to form a trigger switch assembly.

13. The screw-tightening power tool according to claim 1, further comprising a terminal block disposed in the battery mounting part, the terminal block being configured to electrically connect to the battery pack.

14. The screw-tightening power tool according to claim 12, wherein the control circuit board is equipped with a microcontroller, capacitors, switching devices electrically connected to coils on the stator, and a driver that drives the switching devices.

15. The screw-tightening power tool according to claim 1, wherein the first spindle is a part of the clutch.

16. A screw-tightening power tool comprising:
a motor housing;
a brushless motor in the motor housing, the brushless motor comprising a stator and a rotor rotatably mounted relative to the stator;
a grip housing downwardly extending from a lower part of the motor housing;
a cooling fan disposed frontward of the rotor;
a battery mounting part disposed at a lower part of the grip housing;
a rotary shaft affixed to the rotor and extending in a front-rear direction;
a pinion located frontward of the cooling fan and securely mounted to the rotary shaft;
a gear meshed with the pinion and connected to a first cam;
a second cam disposed frontward of the first cam and shiftable in the front-rear direction from a first position spaced from the first cam to a second position meshed with the first cam;
a tip-tool retaining part operably connected to the second cam and configured to hold a bit;
a coil spring biasing the second cam away from the first cam;
an LED located on an upper portion of the battery mounting part, the LED facing diagonally upward and configured to illuminate an area frontward of the bit;
a trigger switch disposed within the grip housing; and a control circuit board configured to control the brushless motor, the control circuit board being disposed within the grip housing below the trigger switch and extending in an up-down direction.

17. The screw-tightening power tool according to claim 16, wherein:

the stator includes a coil and an insulation member having a connecting piece, the connecting piece is disposed above the rotor, and the connecting piece connects the coil to a power cord.

18. The screw-tightening power tool according to claim 17, wherein the power cord passes behind a rear end of the rotary shaft.

19. The screw-tightening power tool according to claim 16, further comprising:

a sensor circuit board disposed rearward of the stator, the sensor circuit board being connected with the control circuit board by a first cord, wherein a power cord passes behind a rear end of the rotary shaft.

20. The screw-tightening power tool according to claim 16, further comprising an operation panel disposed rearward of the LED.

21. The screw-tightening power tool according to claim 16, further comprising another cord that connects the LED to a lower part of the control circuit board.

22. The screw-tightening power tool according to claim 18, further comprising:

a sensor circuit board disposed rearward of the stator, the sensor circuit board being connected with the control circuit board by a first cord, an operation panel disposed rearward of the LED, and another cord that connects the LED to a lower part of the control circuit board.

* * * * *